US009788095B2

(12) United States Patent
Demier

(10) Patent No.: US 9,788,095 B2
(45) Date of Patent: Oct. 10, 2017

(54) STATELESS CORD MANAGEMENT DEVICE

(71) Applicant: Cal T. Demier, Key West, FL (US)

(72) Inventor: Cal T. Demier, Key West, FL (US)

( * ) Notice: Subject to any disclaimer, the term of this patent is extended or adjusted under 35 U.S.C. 154(b) by 106 days.

(21) Appl. No.: 14/660,194

(22) Filed: Mar. 17, 2015

(65) Prior Publication Data

US 2015/0189420 A1 Jul. 2, 2015

Related U.S. Application Data

(63) Continuation-in-part of application No. 14/022,394, filed on Sep. 10, 2013, now Pat. No. 9,143,852.

(51) Int. Cl.
*H04R 1/10* (2006.01)

(52) U.S. Cl.
CPC ..... *H04R 1/1033* (2013.01); *Y10T 24/39* (2015.01); *Y10T 24/3907* (2015.01)

(58) Field of Classification Search
CPC .... H04R 1/1033; Y10T 24/3907; Y10T 24/39
See application file for complete search history.

(56) References Cited

U.S. PATENT DOCUMENTS

| | | | | |
|---|---|---|---|---|
| 1,435,311 | A | 11/1922 | Knight | |
| 1,708,470 | A | 4/1929 | Eckert et al. | |
| 3,636,595 | A | 1/1972 | Wines | |
| 4,285,486 | A | 8/1981 | Von Osten et al. | |
| 4,406,042 | A | 9/1983 | McPhee | |
| 4,958,791 | A * | 9/1990 | Nakamura | B65D 33/1616 24/16 PB |
| 5,130,496 | A | 7/1992 | Jenkins | |
| 5,600,098 | A | 2/1997 | Kazaks | |
| D408,365 | S | 4/1999 | Sanders | |
| 5,895,288 | A | 4/1999 | Nelson | |
| D421,715 | S | 3/2000 | Won | |
| D445,093 | S | 7/2001 | Staskey | |
| 6,425,165 | B2 | 7/2002 | Koppang | |
| 6,425,543 | B1 | 7/2002 | King | |
| D464,875 | S | 10/2002 | Koppang | |
| 7,355,119 | B2 | 4/2008 | Katz et al. | |
| D584,132 | S | 1/2009 | Judd | |
| 7,610,661 | B2 | 11/2009 | Sween et al. | |

(Continued)

FOREIGN PATENT DOCUMENTS

WO 2011149361 A2 12/2011

*Primary Examiner* — Robert J Sandy
*Assistant Examiner* — Louis Mercado
(74) *Attorney, Agent, or Firm* — Malloy & Malloy, P.L.

(57) ABSTRACT

A stateless cord management device for storage and deployment of a cord, cable, or wire including a body having a sidewall with oppositely disposed open ends. A channel is at least partially defined by the sidewall and disposed therethrough between the oppositely disposed open ends. An access opening extends longitudinally along and through the sidewall between the oppositely disposed open ends of the sidewall. The access opening is at least partially defined by cooperatively disposed and abutting free ends of the sidewall, the free ends being at least partially separable from one another permitting access into the channel. A retention member extends into the channel along its width thereby at least partially defining a retention member recess for receipt and retention of at least a portion of a cord, cable, or wire therein.

6 Claims, 6 Drawing Sheets

(56) References Cited

U.S. PATENT DOCUMENTS

| | | | | |
|---|---|---|---|---|
| 7,712,696 | B2 | 5/2010 | Loh | |
| 7,882,600 | B2 | 2/2011 | Judd | |
| 8,635,750 | B1 | 1/2014 | Ginocchio | |
| 2008/0289151 | A1 | 11/2008 | Chan | |
| 2009/0013504 | A1 | 1/2009 | Crespo | |
| 2009/0211063 | A1 | 8/2009 | Ginocchio | |
| 2011/0252606 | A1 | 10/2011 | Rothbaum et al. | |
| 2011/0252607 | A1 | 10/2011 | Rothbaum et al. | |
| 2011/0252608 | A1 | 10/2011 | Rothbaum et al. | |
| 2011/0252609 | A1 | 10/2011 | Rothbaum et al. | |
| 2011/0308049 | A1 | 12/2011 | Sun | |
| 2012/0265714 | A1 | 10/2012 | Duval | |
| 2012/0288132 | A1 | 11/2012 | Massey | |
| 2015/0107058 | A1* | 4/2015 | Wu ..... | H01R 13/60<br>24/129 R |

* cited by examiner

STATELESS CORD MANAGEMENT DEVICE

BACKGROUND OF THE INVENTION

Field of the Invention

The present invention is directed to a device for the management of a variety of cables, cords, and/or wires, wherein the device remains in substantially the same physical state whether storing or deploying a cord, or as releasably attached to the same during use.

Description of the Related Art

Headphones, cables, and power cords are common in today's portable environment for a wide range of mobile devices including music players, laptops, tablet computers, smart phones, wearable electronics, etc. The storage and transport of the cords and wires by a user prove to be problematic, particularly when multiple cords are stored together and become entangled with one another.

Current cable or cord management devices are difficult to use and generally require a user to keep track of an additional component, such as a headphone case or cord winder. Headphone cases require a user to bunch up the cables in order to mold and conform to a case, however, the case does not prevent snags or tangles of the cable. Cord winders allow a user to wind a cord while avoiding tangles, but they generally offer no easy way of removing the bulk of the cord for operation, nor do they remain attached to the cord when it is in use. Thus, cord winders are easily misplaced, left behind, or even lost, and are therefore often unavailable when needed after use of a device.

As such, there is a need for an improved cord management device which overcomes the disadvantages and problems set forth above. Moreover, an improved cord management device can incorporate a variety of unique structural and operative features which are pleasing to consumers and can be produced at a reasonable cost. Such an improved cord management device will facilitate the ease of winding or unwinding of the cord to a desired length during use, as well as the bulk removal of the cord from the device, and has the ability to remain attached to at least a portion of a cable or cord during use in an obtrusive manner. In addition, such an improved cord management device can include printed or otherwise formed indicia disposed thereon in an observable location, thereby serving as an advertising and marketing tool and/or as an added decorative feature thereof.

SUMMARY

The present invention is directed to a stateless cord management device. The device allows attachment to at least a portion of a cord, facilitates the ease of winding or unwinding the cord to a desired length during use, as well as the bulk removal of the cord from the device.

A stateless cord management device may be of a singular, integral construction in at least one embodiment. Unlike known cord management devices, the present stateless cord management device does not require the fabrication of multiple, discrete components, nor does it require assembly of such components in an assembly process.

More in particular, in at least one embodiment, a stateless cord management device in accordance with the present invention generally comprises a body having a sidewall with oppositely disposed open ends, the sidewall defining a channel therethrough. The sidewall further comprises abutting free ends which are cooperatively structured to at least partially define an access opening into the channel.

The body may comprise any of a number of geometric configurations including but in no manner limited to triangular, tetragonal, cylindrical, etc. In other embodiments, the body may comprise a spherical, cubic, or tubular configuration.

In at least one embodiment, the channel is at least partially defined by the sidewall and is disposed therethrough between the oppositely disposed open ends. The channel is dimensioned to retain at least a portion of the cord therein.

An access opening extends longitudinally along and through the sidewall, and in at least one embodiment, is disposed between the oppositely disposed open ends. In one further embodiment, the access opening is at least partially defined by cooperatively structured abutting free ends to permit access into the channel. The cooperatively structured abutting free ends are structured of a resilient material, in at least once embodiment, such that the access opening is normally biased into a closed configuration in order to retain a portion of the cord within the channel. Further, when winding or unwinding the cord, the abutting free ends of the access opening separate from one enough a sufficient distance to allow the cord to enter or exit the channel through the access opening, when external force is applied by the cord. In at least one further embodiment, the sidewall is sufficiently flexible to allow for the bulk removal or the removal of a cord from the channel through the access opening.

At least one embodiment of the present invention comprises a retention assembly to facilitate receipt and retention of at least one end of a cord therein. The retention assembly comprises at least one retaining slit through at least a portion of the sidewall. The retention assembly allows the stateless cord management device to be releasably attached to a portion of a cord, and to retain the cord management device to a portion of the cord, regardless of whether the cord is stored or deployed, thereby alleviating the need to keep track of an additional and separate storage component.

The sidewall comprises at least one notch proximate one of the open ends in aligned relation to the access opening, in at least one embodiment of the present invention. The notch facilitates receipt of a portion of a cord and passage of at least the portion of the cord through the access opening into the channel. In at least one embodiment, the sidewall comprises a first notch proximate a first open end, and a second notch is proximate a second open end, both the first notch and the second notch disposed in an aligned relation with the access opening. The notch or notches in this embodiment facilitate receipt of a cord during a winding operation for storage or to adjust its length during use.

At least one display area is formed on the body in at least one embodiment of the present invention. The display area may comprise design indicia such as, but not limited to, logos, graphics, text, symbols and characters, or any combinations thereof. The display area may be formed on the interior or exterior of the body. A plurality of display areas may be formed along the body, in at least one embodiment.

One alternative embodiment of a retention assembly in accordance with the present invention includes a retention member disposed on the sidewall and extending therefrom into the channel. A retention member recess is at least partially defined by a partially enclosed space between the retention member and the sidewall and an offset distance therebetween, wherein the offset distance is a maximum distance between the retention member and the sidewall. Furthermore, a retention member gap is at least partially defined by a gap distance between a distal end of the retention member and the sidewall, wherein the gap distance is minimum distance between the distal end of the retention member and the sidewall. As such a cord may be inserted into the channel, through the access opening, and then passed through the retention member gap into the retention member recess. When so disposed, the device traverses the cord however, in at least one embodiment, a connector of the cord is prevented from passing into or through the retention member recess unassisted.

It will be appreciated that although the depicted embodiments include a cord and a connector of the type generally used with earbuds or headphones, the present invention may be adapted to a variety of other cords, cables, or hoses, such as power cables, communication cables, and hoses of a variety of sized and lengths, and a corresponding variety of connectors or other terminal members such as electrical, mechanical, or hydraulic connectors, adaptors, etc.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION

As stated above, the present invention is directed to a stateless cord management device for storage and deployment of a cord, generally shown as 100 in the accompanying figures.

Figure 1:
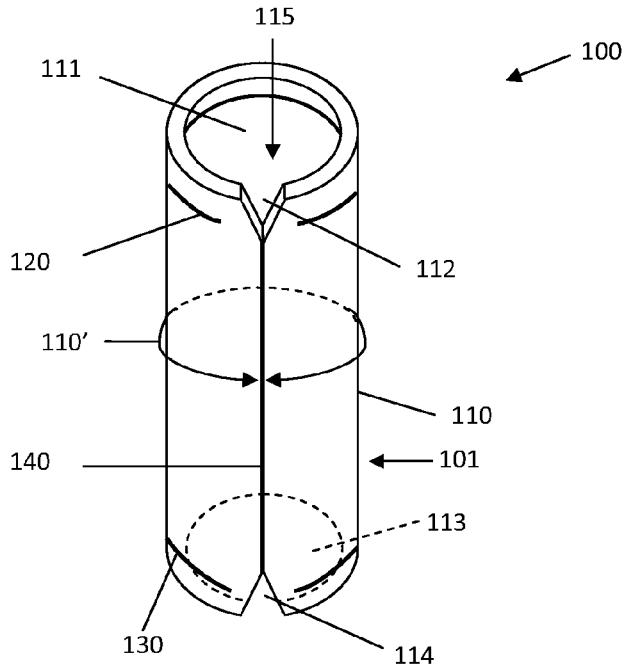
FIG. 1 is a front perspective view of one illustrative embodiment of a stateless cord management device in accordance with the present invention.

FIG. 1 presents a front perspective view of one illustrative embodiment of a stateless cord management device 100 for storage and deployment of a cord in accordance with the present invention. As shown in FIG. 1, the stateless cord management device 100 comprises a body 101 having a sidewall 110 with oppositely disposed open ends, namely, first open end 111 and second open end 113.

In the embodiments shown in the accompanying figures, the sidewall 110 comprises a substantially cylindrical configuration at least partially defined by a circumference 110'. Of course, it is within the scope and intent of the present invention for the sidewall 110 to comprise any of a number of other geometric configurations including, but in no manner limited to, polygonal, spherical, cubic, tubular, oval, elliptical, etc. Further, the outside and inside dimensions are variable to so to permit use of the present invention for the retention of phone cords, power adapters, communication cables, such as USB, Ethernet, HDMI, as well as any of a variety of other cords, wires, cables, hoses, etc., of various sizes and lengths.

Figure 3:
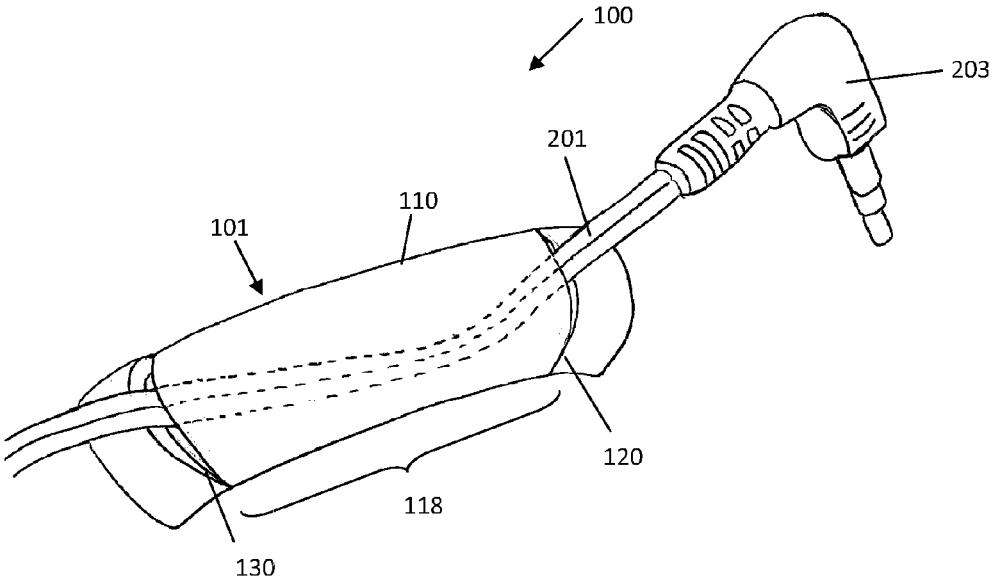
FIG. 3 is a perspective view of the stateless cord management device of FIG. 1 having one end of a cord releasably retained by a retention assembly.

As shown in FIG. 1, in at least one embodiment, a channel 115 is at least partially defined by the sidewall 110 and is disposed therethrough between the oppositely disposed open ends 111 and 113. The channel 115 is dimensioned to retain at least a portion of a cord 201 therein, as illustrated in the embodiment of FIG. 3.

Figure 2:
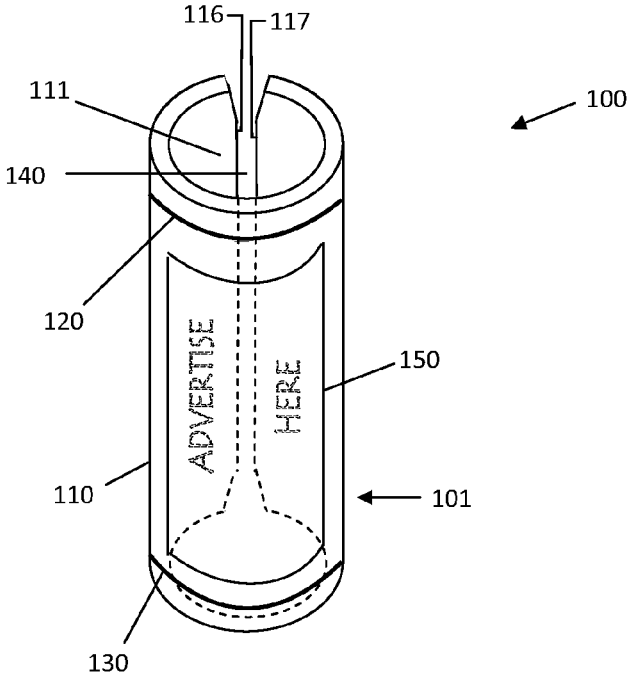
FIG. 2 is a rear perspective view of the stateless cord management device of FIG. 1.

As illustrated best in FIG. 1, an access opening 140 is disposed between oppositely disposed first open end 111 and second open end 113, and extends longitudinally along and through the body 101. The access opening 140 is at least partially defined by cooperatively structured abutting free ends 116 and 117 of the sidewall 110, as shown in FIG. 2. As further illustrated in FIG. 2, the abutting free ends 116 and 117 are at least partially separable from one another to permit access into the channel 115 by a cord.

Figure 4:
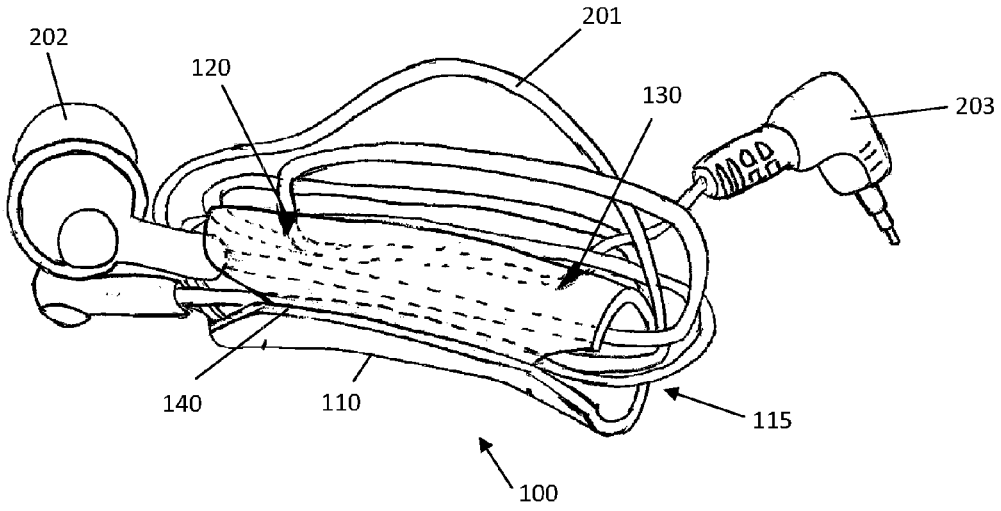
FIG. 4 is a perspective view of the stateless cord management device of FIG. 1 having a portion of a cord retained within a channel.

In at least one embodiment, the access opening 140 will retain a normally closed configuration as shown best in FIGS. 1 and 4. Accordingly, separation of the abutting free ends 116 and 117 will occurs only upon an exertion of external force, in at least one embodiment, such as when a cord is wound or unwound through the access opening 140.

In at least one embodiment, the sidewall 110 is formed from a flexible material to permit the abutting free ends 116 and 117 to be easily separable from one another to permit access into the channel 115 by a portion of the cord 201. In at least one further embodiment the sidewall 110 comprises a material of construction which is sufficiently resilient to bias the access opening 140 into a normally closed configuration, such as is shown in FIGS. 1 and 4, in order to retain storage at least a portion of a cord 201 within the retention channel 115, such as is shown in FIG. 4.

As shown in FIG. 3, the sidewall 110 comprises a retention assembly 118 in at least one embodiment of the present invention. The retention assembly 118 facilitates receipt and retention of at least a portion of a cord 201 therein. The retention assembly 118, in at least one embodiment, comprises at least one retaining slit 120 through at least a portion of the sidewall 110. In the embodiment of FIG. 3, a headphone connector 203 and a portion of a cord 201 is passed through a pair of retaining slits 120 and 130, thereby retaining a portion of the cord 201 therein to be retained therein. The retaining slits 120 and 130 may be disposed proximate the open ends 112 and 113, as shown in the embodiment of FIG. 3, however, it is understood to be within the scope of the present invention for other embodiments to comprise one or more retaining slit 120, 130 through other portions of a sidewall 110. Furthermore, the retaining slits 120. 130 may be disposed longitudinally, latitudinally, diagonally, etc., relative to the sidewall 110. In yet another embodiment, the retaining slits 120, 130 comprise an overlying configuration, for example, a cross or an configuration.

At least one notch is formed in a sidewall 110 of the body 101 of a stateless cord management device 100 in accordance with at least one embodiment of the present invention. Looking again to the illustrative embodiment of FIG. 1, a first notch 112 is formed proximate first open end 111, and the first notch 112 is disposed in an aligned relation to access opening 140. The first notch 112 facilitates receipt of a portion of a cord 201 and passage of at least the portion of the cord through the access opening 140 into the channel 115. In addition, the illustrative embodiment of FIG. 1 comprises a second notch 114 proximate the second open end 113, and also in aligned relation with the access opening 140. The first notch 112 and the second notch 114 cooperatively facilitate receipt of a portion of a cord at each of the first notch 112 and the second notch 114, and passage of at least a portion of the cord through the access opening 140 into the channel 115. This increases the ease of winding a cord 201 onto a stateless cord management device 110 for storage, as shown in FIG. 5, or to adjust its length during use.

At least one display area 150 may be formed on the body 101 of a stateless cord management device 100 in accordance with the present invention. A display area 150 comprises design indicia such as but not limited to logos, graphics, text, symbols and characters, or any combinations thereof. The display area 150 is visible along at least a portion of the body 101, in some embodiments, and in other embodiments, the display area 150 comprise substantially the entire surface of the body 101. A plurality of display areas 150 may also be employed, each display area 150 being visible along a different corresponding portion of the body 101. In at least one embodiment, such as is shown in FIG. 2, the display area 150 serves advertising or marketing purposes. In at least one further embodiment, custom design indicia is incorporated onto the display area 150.

Figure 5:
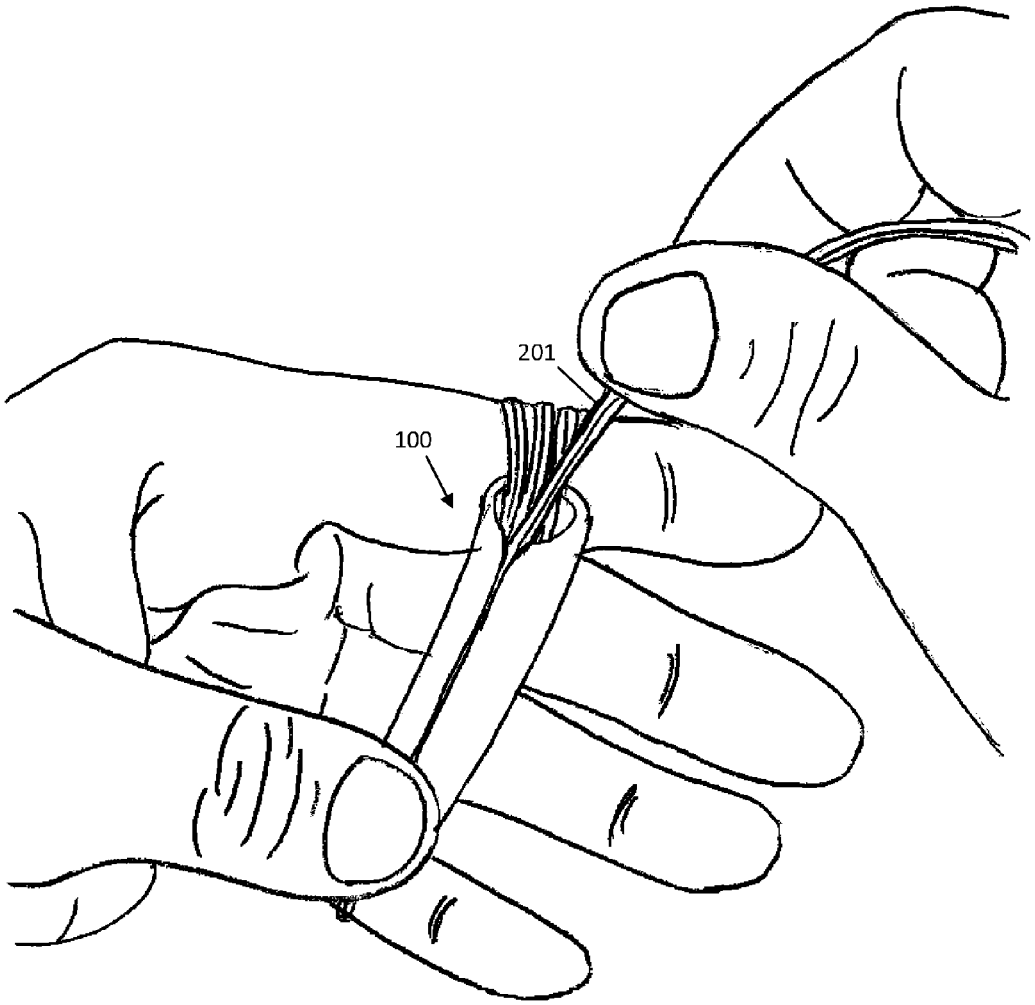
FIG. 5 is a perspective view illustrating the use of one embodiment of a stateless cord management device in accordance with the present invention.

Operation of one embodiment of a stateless cord management device 100 in accordance with the present invention is illustrated in FIGS. 3 through 5. In FIG. 3, one end of a pair of headphones, such as a headphone connector 203, is inserted through retaining slits 130 and 120. The retaining slits 130, 120 in this embodiment are disposed along and through at least a portion of the sidewall 110 along a circumference 110' thereof. In at least one embodiment, the retaining slits 120, 130 are disposed through a majority of the sidewall 110 to allow the sidewall 110 to be easily bent to facilitate opening and insertion of cord, wire, or cable, such as a headphone connector 203 and at least a portion of a cord 201, through retaining slits 120, 130. The remainder of the cord 201 may then be wound into the channel 115 for storage, such as is shown in FIG. 4. The cord 201 may be selectively wound to shorten the cord 201 length, or unwound to extend the cord 201 length available during use. This, for instance, allows a user to adjust a cord 201 to the desired length during use. For storage, portions of the cord 201 are wound through the access opening 140 into the channel 115. As shown in the embodiment of FIG. 4, when the cord 201 is wound into channel 115, the ear buds 202 becomes proximately disposed to the body 101 of the cordless management device 100. As will be appreciated, the present stateless cord management device facilitates storage and transit of a pair of portable headphones with ease, while reducing the possibility of tangling of the cord 201.

In at least one embodiment, a stateless cord management device 100 in accordance with the present invention comprises a unitary construction. Further, a body 101 in accordance with at least one embodiment of the present invention is at least partially formed of a flexible material to allow access into the channel 115 through the access opening 140, upon the application of external force when a cord 201 is being wound onto or unwound form the channel 115. A flexible or resilient material of construction of the body 101 and/or sidewall 110 retains the access opening 140 in a closed configuration when no external force is applied, as illustrated in FIG. 1. The body 101 of the present invention may further be formed of a light weight material to facilitate wear ability.

As one example, a stateless cord management device 100 in accordance with the present invention comprises a vinyl tubing material of construction. The vinyl tubing, in at least one embodiment, comprises an outside diameter of about one-half inch and an inside diameter of about three-eighths inch for the retention of portable headphone cables. Alternate embodiments may comprise other flexible and/or resilient materials such as latex, rubber, plastic, etc. Further embodiments of a stateless cord management device 100 in accordance with the present invention comprise a vulcanized ethylene propylene diene monomer in a thermoplastic matrix of polypropylene, commonly referred to as a thermoplastic elastomer or thermoplastic vulcanizate, such as SANTOPRENE™ produced by Exxon Mobil Corp. Such thermoplastic elastomers or thermoplastic vulcanizates provide the strength and durability of vulcanized rubber materials, but with the added benefit of recyclability, due to the thermoplastic nature of the material.

Figure 6:
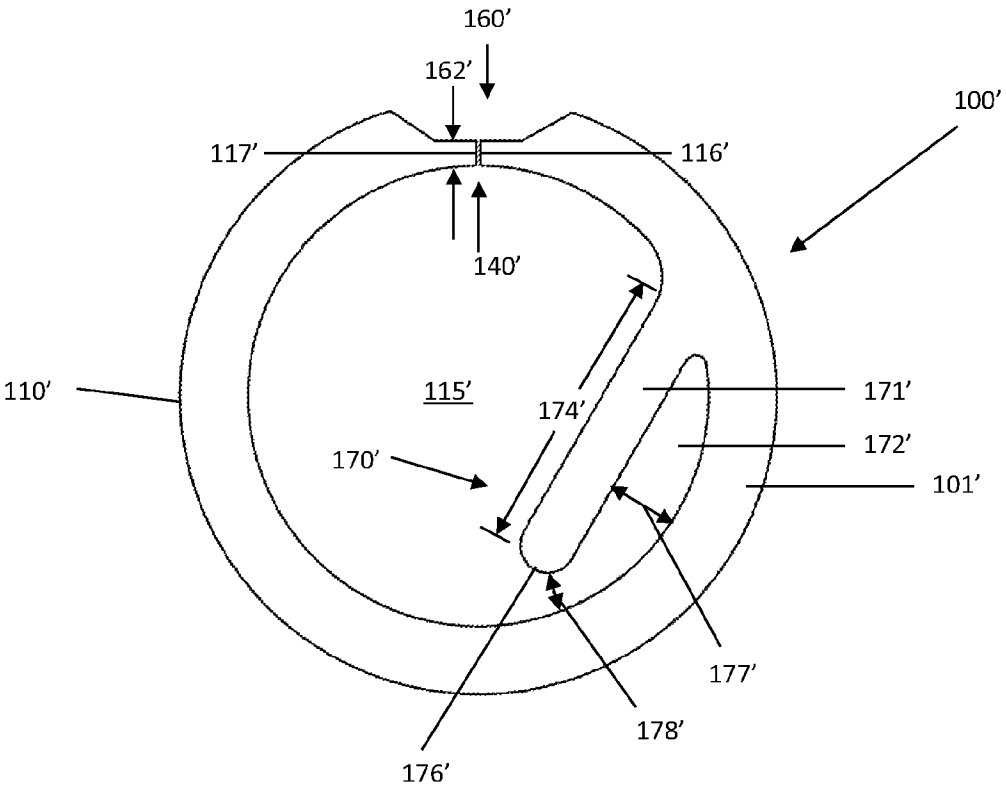
FIG. 6 is an end elevation of another illustrative embodiment of a stateless cord management device in accordance with the present invention.
Figure 7:
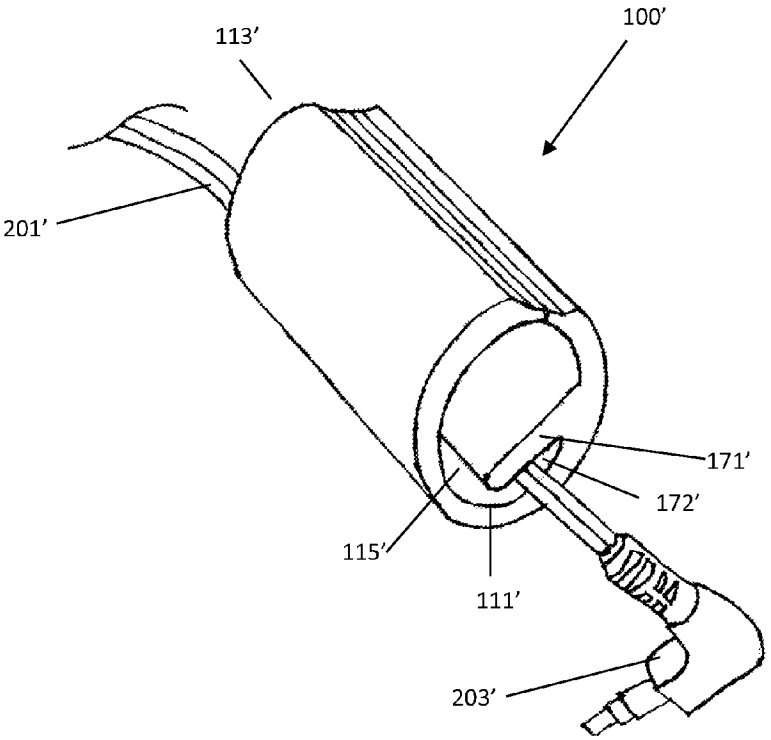
FIG. 7 is a perspective view of the stateless cord management device of FIG. 6 having a portion of a cord retained therein.
Figure 8:
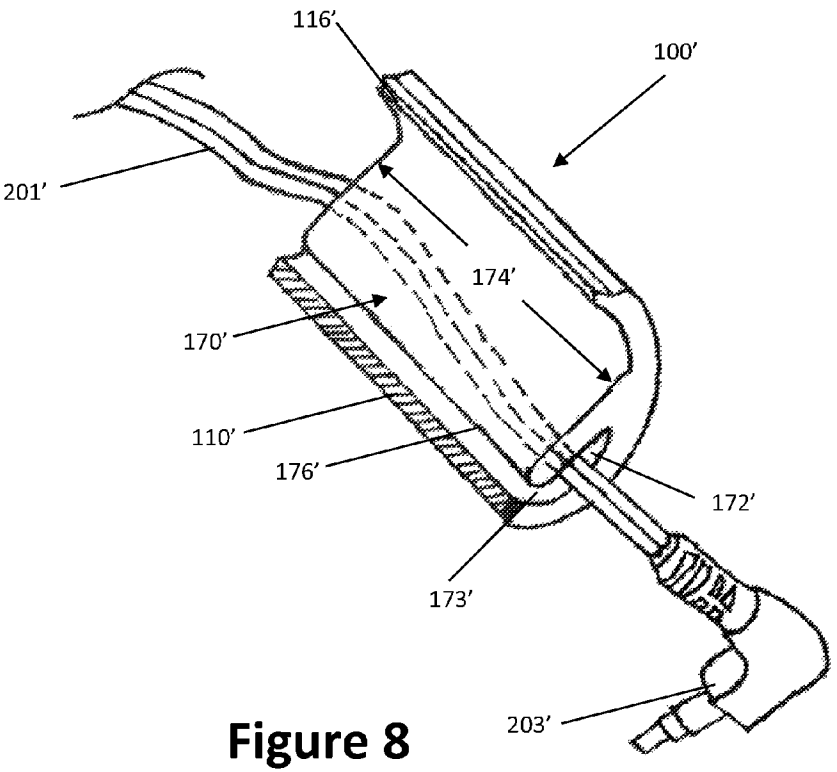
FIG. 8 is a partial cutaway view of the stateless cord management device of FIG. 7.

FIGS. 6 through 8 present another illustrative embodiment of a stateless cord management device 100' in accordance with the present invention. More in particular, the embodiment of the stateless cord management device 100' of FIGS. 6 through 8 comprises a retention assembly 170'. As shown in the figures, the retention assembly 170' includes a retention member 171' having a length 174' and width 175'. The retention member 171' is attached to a sidewall 110' and extends into a channel 115' therefrom. Further, the retention member 171' comprises a distal end 176' which terminates in the channel 115'. In at least one embodiment, the retention member 171' is formed integrally with sidewall 110'.

The retention assembly 170', in at least one embodiment, also includes a retention member recess 172'. The retention member recess 172' is at least partially defined by the partially enclosed space between the retention member 170' and the sidewall 110'. Additionally, and as shown in the illustrative embodiment of FIG. 6, an offset dimension 177' is at least partially defined by a maximum dimension between the retention member 171' and the sidewall 110'. In one further embodiment, the offset dimension 177' is greater than a minimum cross-sectional dimension of a cord 201 to be retained in the stateless cord management device 100', but is less than a minimum cross-sectional dimension of a connector 203 attached to one end of the cord 201. As such, when at least a portion of the cord 201 is disposed within the retention member recess 172', the device 100' is substantially free to traverse the cord 201 unimpeded, however, the connector 203 is not able to pass through the retention member recess 172'. In an embodiment where the cord 201 comprises a headphone cord and the connector comprises a 3.5 millimeter headphone jack, the offset dimension 177' is on the order of about 3 millimeters to about 10 millimeters.

Looking again to the illustrative embodiment of FIG. 6, a gap distance 178' is at least partially defined as a minimum distance between the distal end 176' of the retention member 171' and the sidewall 110'. In at least one embodiment, the gap distance 178' is dimensioned so as to substantially restrict unassisted passage of a cord 201 therethrough. Stated otherwise, in at least one embodiment, the gap distance 178' provides a clearance for an object to be pass between the retention member recess 172' and the channel 115', thus requiring assisted passage therethrough. Thus, in at least one embodiment, a gap distance 178' is dimensioned so as to prevent a cord 201 from passing therethrough without assistance, such as an external force applied by a user. Once again, in an embodiment where the cord 201 comprises a headphone cord and the connector 203 comprises a 3.5 millimeter headphone jack, the gap distance 178' is on the order of about 1 millimeter to about 5 millimeters.

In yet one further embodiment, a stateless cord management device 100' in accordance with the present invention includes a relief channel 160' disposed substantially along and/or concurrent with an access opening 140', as shown best in the illustrative embodiments of FIGS. 6 and 7. The relief channel is at least partially defined by a reduced thickness 162' of the sidewall 110' proximate to the first free end 116' and second free end 117' of the access opening 140'. Further, in at least one embodiment, a relief channel 160' comprises at least one sloped sidewall 164', and in one further embodiment, a relief channel comprises a pair of oppositely disposed sloped sidewalls 164', such as is shown best FIG. 6. As will be appreciated, the sloped sidewalls 164' will facilitate alignment of a cord 201 with the access opening 140' of a stateless cord management device 100' in accordance with the present invention. Further, the reduced thickness 162' of the sidewall 110' in the relief channel 160' allows for easier passage of portions of a cord 201 into and out of channel 115' through access opening 140', thus making the device 100' easier to use.

As may best be seen in the illustrative embodiments of FIGS. 7 and 8, the length 174' of the retention member 171' extends substantially between the first open end 111' and the second open end 113' of the stateless cord management device 100'. However, it will be appreciated that the length 174' of the retention member 171' may be varied to suit different operating conditions for the device 100'.

Figure 9A:
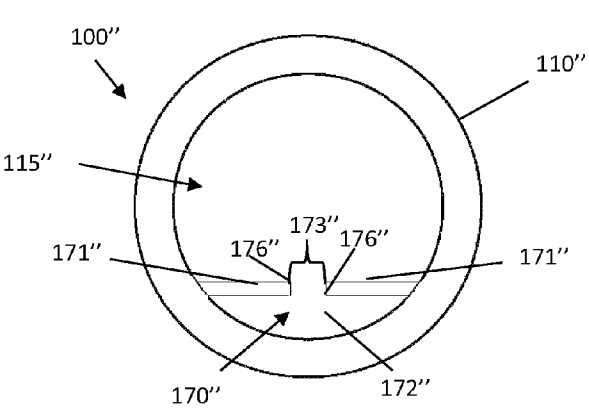
FIG. 9A is an end elevation of one other illustrative embodiment of a stateless cord management device in accordance with the present invention.
Figure 9B:
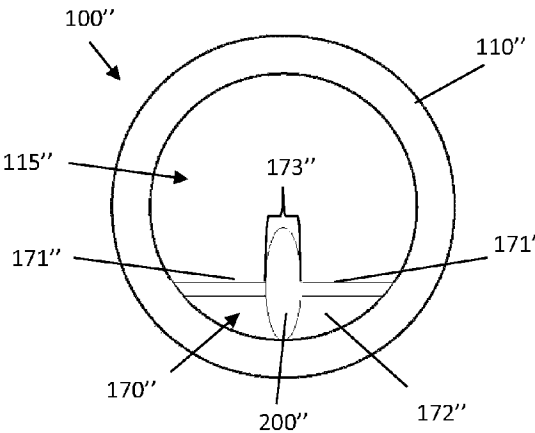
FIG. 9B is an end elevation of the stateless cord management device of FIG. 9A having a portion of an oval cord partially disposed into a retention member recess thereof.

Turning next to the illustrative embodiment of FIG. 9A, a retention assembly 170" comprises a plurality of retention members 171". As depicted in FIGS. 9A through 9D, a pair of retention members 171" extend into the channel 115" toward one another from oppositely disposed portions of the sidewall 110". As such, an alternative embodiment of a retention member gap 173" is thereby defined as the distance between the distal ends 176" of each of the plurality of retention members 171". Accordingly, as shown in the illustrative embodiments of FIGS. 9A through 9D, a retention member recess 172" comprises an at least partially enclosed space between each of the plurality of retention members 171" and the sidewall 110".

Figure 9D:
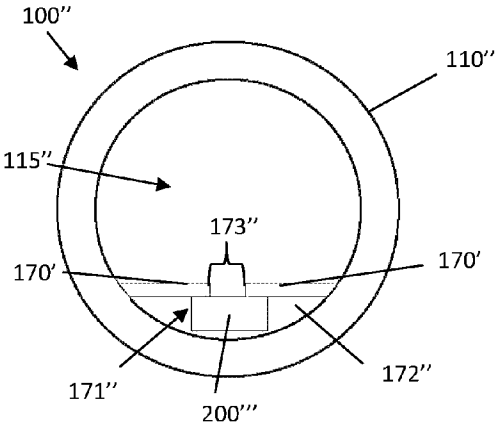
FIG. 9D is an end elevation of the stateless cord management device of FIG. 9A having a portion of a square cord partially disposed into a retention member recess thereof.
Figure 9C:
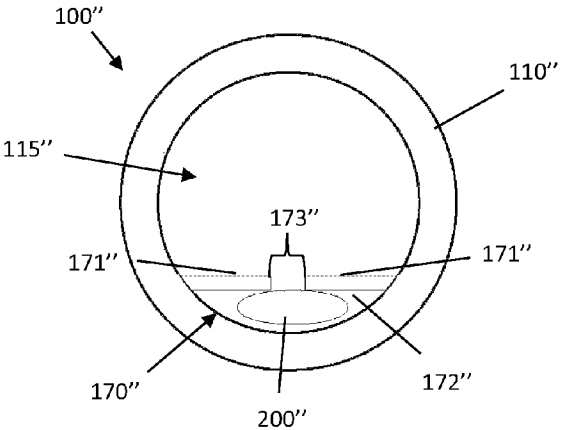
FIG. 9C is an end elevation of the stateless cord management device of FIG. 9B having the portion of the oval cord fully disposed into the retention member recess thereof.

FIGS. 9C and 9D are illustrative of an alternate embodiment of a stateless cord management device 100" in accordance with the present invention each having a portion of a cord 200 disposed in a retained relation in a retention member recess 172" thereof. The cord 200 as shown in FIG. 2C comprises a generally oval cross-sectional configuration, while the cord 200 as shown in FIG. 9D comprises a generally square or rectangular cross-sectional configuration.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A stateless cord management device for storage and deployment of a cord having a connector attached to at least one end thereof, said device comprising:

a body comprising a sidewall having a pair of oppositely disposed open ends, said sidewall comprising a substantially cylindrical configuration, an elongated channel at least partially defined by said sidewall and disposed therethrough between said pair of oppositely disposed open ends, said elongated channel comprising a length at least partially defined by a distance between said pair of oppositely disposed open ends, said elongated channel having a cylindrical configuration defining an effective diameter of said elongated channel, said length of said elongated channel is greater than said effective diameter of said elongated channel, a plurality of retention members each having a length and a width, wherein each of said plurality of retention members extends into said channel from oppositely disposed portions of said sidewall towards one another, wherein said plurality of retention members are disposed in a substantially coplanar orientation with one another, and said plurality of retention members and said sidewall at least partially defining a retention member recess, wherein a portion of the cord is disposable into a retained relation between said retention members and said sidewall in said retention member recess.

2. The device as recited in claim 1 wherein each of said plurality of retention members further comprise a distal end.

3. The device as recited in claim 2 further comprising a retention member gap at least partially defined by a gap distance between said distal ends of said plurality of retention members.

4. The device as recited in claim 3 wherein said retention member gap is dimensioned to substantially restrict unassisted passage of the cord through said retention member gap.

5. The device as recited in claim 1 wherein said length of said elongated channel is at least twice said effective diameter of said elongated channel.

6. The device as recited in claim 1 wherein said length of said elongated channel is at least three times said effective diameter of said elongated channel.

* * * * *